United States Patent [19]

Leib

[11] 4,060,277

[45] Nov. 29, 1977

[54] MODULAR FURNITURE

[76] Inventor: Roger K. Leib, 11740 Wilshire Blvd., Los Angeles, Calif. 90025

[21] Appl. No.: 629,898

[22] Filed: Nov. 7, 1975

[51] Int. Cl.[2] ..... A47C 13/00

[52] U.S. Cl. ..... 297/248; 297/118

[58] Field of Search ..... 297/248, 249, 232, 118, 297/135, 445, 440; D6/56, 60

[56] References Cited

U.S. PATENT DOCUMENTS

| | | | |
|---|---|---|---|
| D. 126,998 | 5/1941 | Bersin | D6/60 |
| 1,842,054 | 1/1932 | Sobel | 297/232 |
| 2,979,122 | 4/1961 | Knoll | D6/61 X |
| 3,123,399 | 3/1964 | Wilson | 297/248 X |
| 3,226,071 | 12/1965 | Eames et al. | 297/248 |
| 3,261,640 | 7/1966 | Straits | 297/248 X |
| 3,492,046 | 1/1970 | Wittner et al. | 297/248 |
| 3,494,662 | 2/1970 | Schaffer et al. | 297/232 |
| 3,528,096 | 9/1970 | Moberg | 297/232 |

*Primary Examiner*—James T. McCall
*Attorney, Agent, or Firm*—Keith D. Beecher

[57] ABSTRACT

Modular multiple lounge seating and table furniture is provided which includes a tubular support frame. The tubular support frame is formed of a plurality of modular pairswhich may be intercoupled into a variety of configurations. Each modular pair includes a module individually formed of a U-shaped elongated tubular member having its closed end bent down into a plane extending substantially perpendicular to the plane of its open end. A cross bar is mounted across the open end of each module, and two such modules are coupled together by couplings between the respective bent-down portions to form the modular pair. A succession of such modular pairs may be intercoupled by couplings between open ends of the tubular members, between the respective cross bars at the open ends thereof, or by other means, so as to provide an assembly of any desired number of modular pairs, and of any desired configuration. Seat cushions, table tops, or other appropriate components, are mounted on each modular pair. Cushion back rests and arm rests may also be provided, as will be described.

10 Claims, 11 Drawing Figures

MODULAR FURNITURE

BACKGROUND OF THE INVENTION

Although many types of furniture are available for use in reception rooms, stores, hotel lobbies, offices, airports, and the like, there still is a requirement for modular furniture of which all parts have a related appearance, and which is able to yield a large variety of configurations to accommmodate to varying design needs and room dimensions, and which is integrally includes tables, benches, backs and arms in the same system.

The furniture of the present invention is particularly suited to meet the requirements set forth above. The individual paired modular support frames of the furniture of the invention may be inter-coupled into furniture units such as seats, benches, table tops, and the like, rigidly connected together by couplers. The furniture units may then be adapted to fit any particular room shape or size, and to have any particular size, shape and relationship, so as to meet a wide range of spatial and functional criteria. The resulting furniture unit, as will be described, may be either straight-line, curved, angled, cornered, or of other configuration. The individual modular pairs and modules can be easily disassembled and re-assembled into different patterns, as desired.

A primary object of the invention, therefore, is to provide a furniture assembly made up of individual modular pairs, which readily lends itself to custom assembly in a wide range of different designs and configurations, and which embodies a fluid contemporary design of functional modules of relatively simple construction, the modular pairs being rigidly intercoupled in a relatively simple manner into a rigid structure, this being achieved by improved and simple couplers.

BRIEF DESCRIPTION OF THE DRAWINGS

FIG. 10 is a perspective representation of two end units with end arms and backs added separated by a support frame for a mid-table, bench, or the like.

DETAILED DESCRIPTION OF THE ILLUSTRATED EMBODIMENTS

Figure 1:
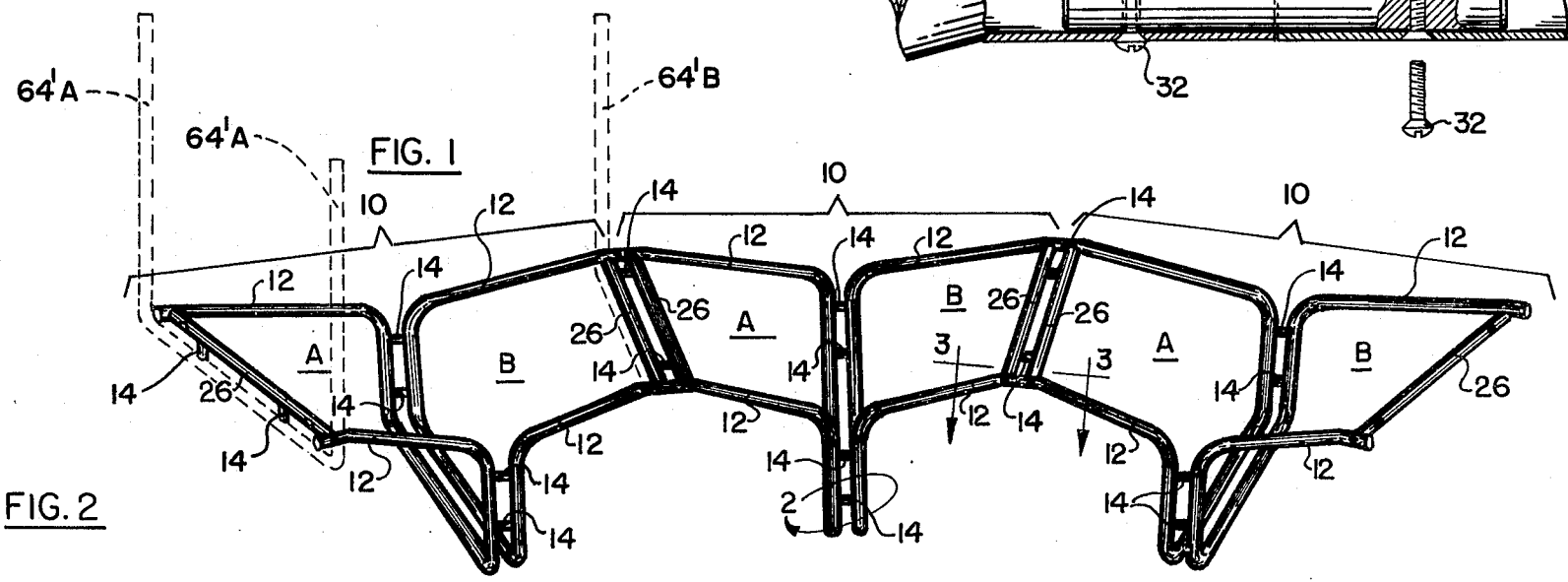
FIG. 1 is a perspective representation of the tubular support frame of a furniture assembly constructed in accordance with the invention, and showing by way of example three modular pairs intercoupled into a rigid support frame.
Figure 4:
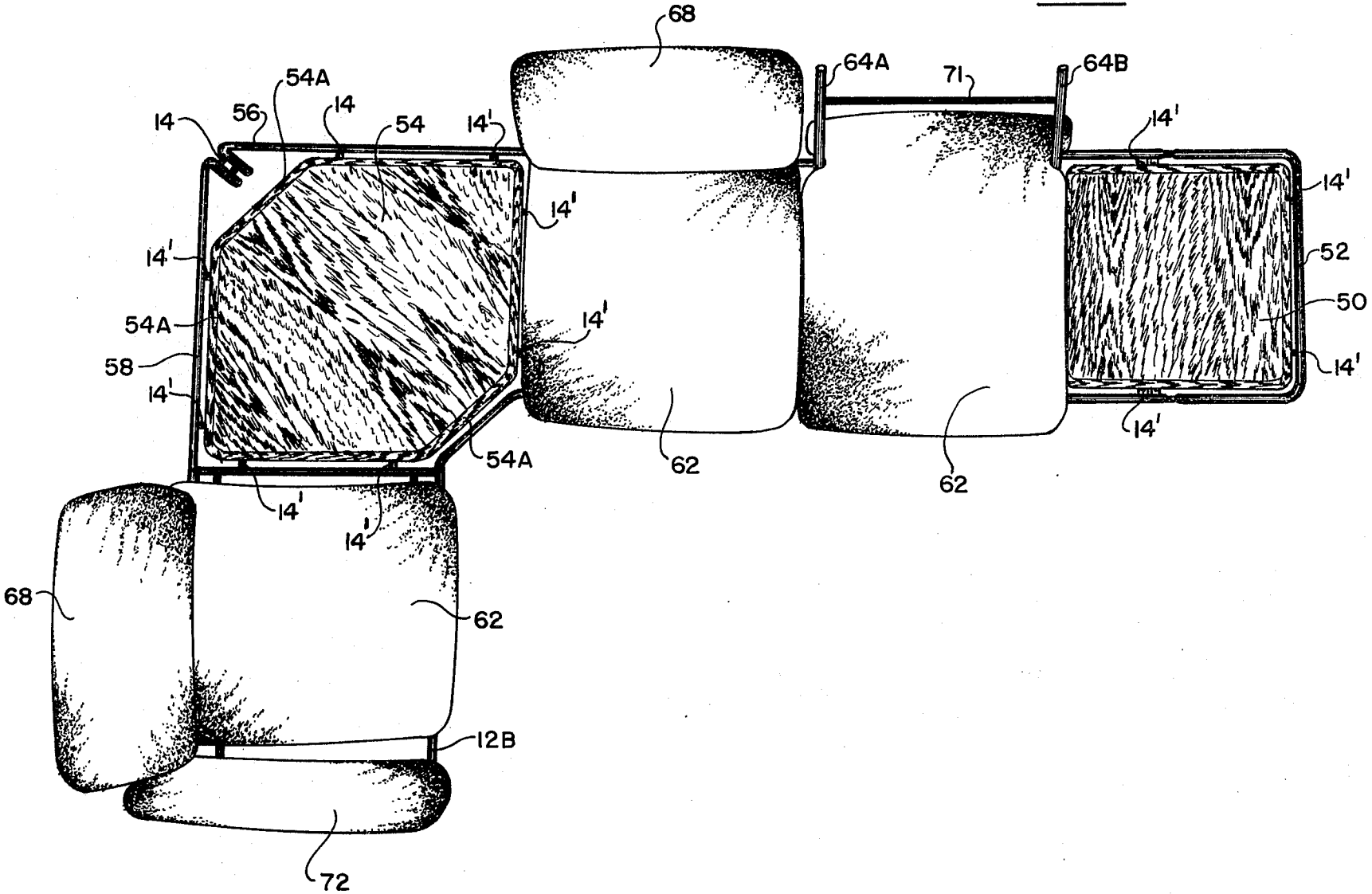
FIG. 4 is a top plan view of a multiple seating and table furniture unit incorporating the concepts of the present invention.

As stated above, the structure of FIG. 1 represents the support frame of a modular furniture unit constructed in accordance with the invention in one of its embodiments, and which includes, for example, three modular pairs, individually designated 10. The particular frame structure of FIG. 1 is shown to extend along a curved path. However, it will be understood that the structure could be linear, and also could be shaped as a right angle, as shown in FIG. 4, for a corner assembly, or it may have any other appropriate configuration.

Each of the modular pairs 10 of FIG. 1 is formed of a pair of modules designated A and B. Each module, in turn, is formed of a U-shaped elongated tubular member 12. The configuration of the elongated tubular member 12 is such that each module has a normally closed end and a normally open end. The elongated member of each module is bent about an intermediate axis, so that the portion adjacent the closed end of the module extends in a generally vertical plane, and the portion adjacent the open end of the module extends in a generally horizontal plane. Also, the configuration is such that both of the above-mentioned portions circumscribe generally rectangular areas. The resulting upright portions of the adjacent elongated members 12 are intercoupled by individual couplers 14, the details of which are shown in the enlarged representation of FIG. 2.

Figure 2:
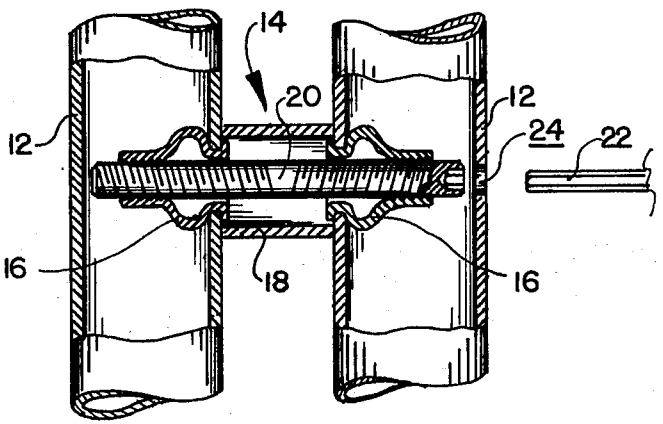
FIG. 2 is an enlarged view, partly in section, taken in the area designated 2 in FIG. 1, and showing the structural details of a coupler which is used, together with a plurality of similar couplers, to interconnect the modules and modular pairs in the structure of FIG. 1.

As shown in FIG. 2, each coupler 14 includes a pair of axially aligned threaded fittings 16 which are mounted in holes in the adjacent tubular members 12, and which are separated by a tubular bushing 18 coaxial with the fittings. A threaded rod 20 extends through the fittings and coaxially through the bushing. The rod 20 is threaded in opposite directions, so that when it is turned in one direction it tightens the tubular members 12 against the ends of bushing 18, and when it is turned in the opposite direction it loosens the assembly. The rod 20 may be turned by an appropriate wrench, such as an Allen wrench 22, inserted through a hole 24 in one of the tubular members 12. All the couplers 14 may have the construction shown in FIG. 2.

Figure 3:
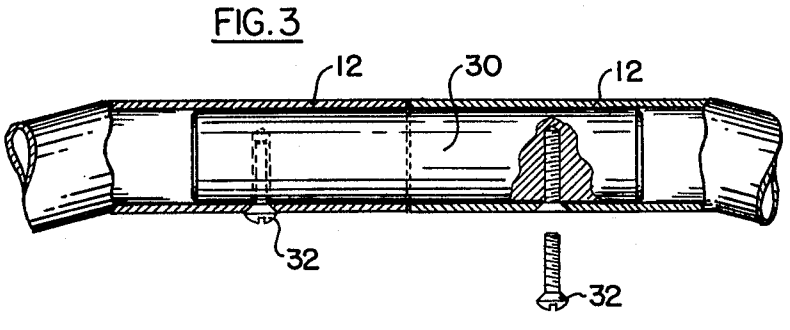
FIG. 3 is an enlarged sectional view, taken along the line 3—3 of FIG. 1, and showing details of a plug insert which is used to intercouple adjacent ones of the modular pairs.

As shown in FIG. 1, the open end of each of the modules is closed by a cross bar 26, and the adjacent cross bars 26 of the successive modular pairs are intercoupled by further couplers 14. Additional or alternate coupling between the modular pairs may be achieved, for example, by plug-like inserts 30 (FIG. 3) which extend into the juxtaposed ends of the tubular members 12 of the adjacent pairs. The plugs are used to maintain alignment of the intercoupled modules, and may also be used to hold the modules together by means of appropriate screws, such as screws 32. The plug inserts are normally solid rods without the screws. If desired, one or two holes may be tapped into the rods to receive corresponding screws. The couplers are used in conjunction with assemblies which are too large to ship as a single unit.

Figure 5:
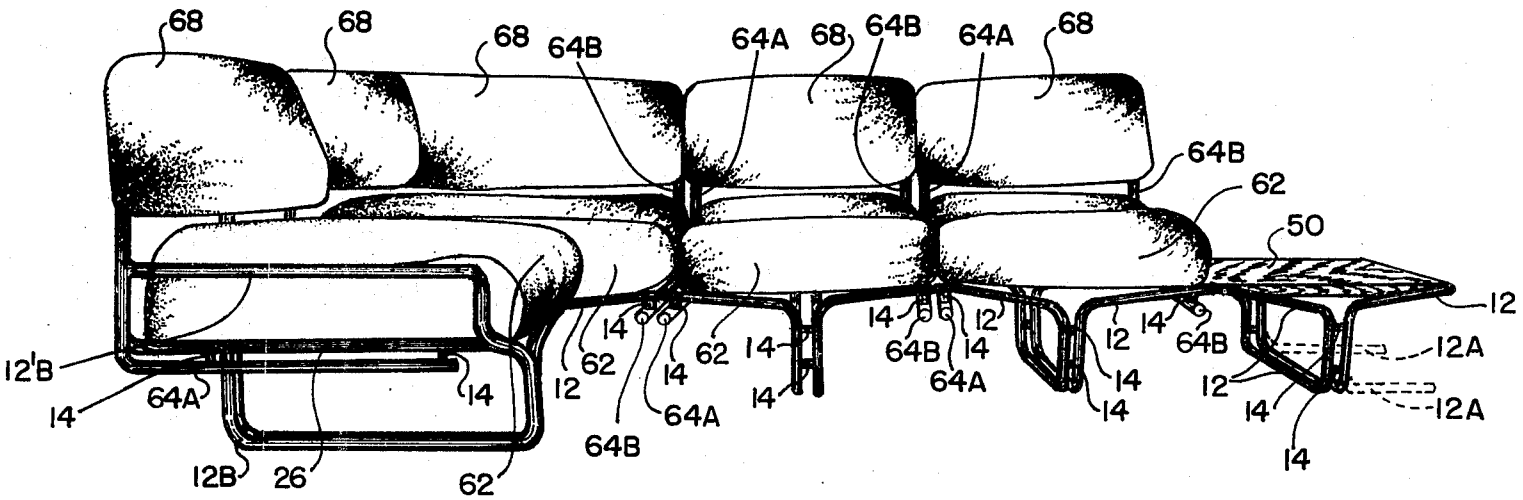
FIG. 5 is an elevational view of a unit similar to the unit of FIG. 4, but with a table top replaced by an additional corner seating module.
Figure 9:
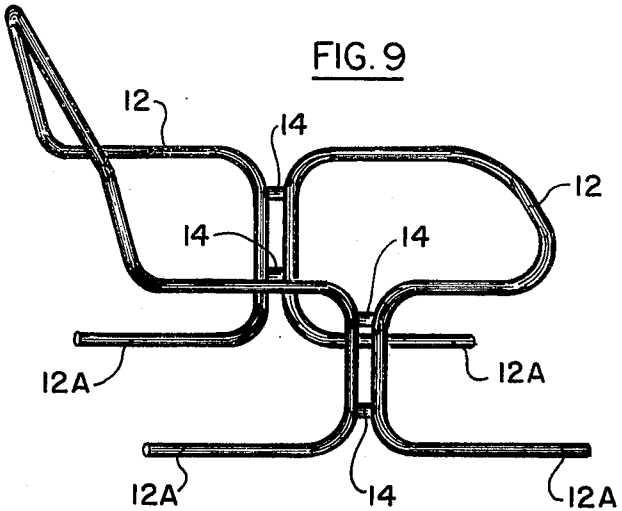
FIG. 9 is a perspective representation of a freestanding modular pair to constitute a support frame for a chair, bench, or the like, with a side arm support.

The multiple furniture unit of FIGS. 4 and 5 is formed of a frame comprising the modular pairs of FIG. 1. However, the frame used in the unit of FIGS. 4 and 5 is rectangular, and formed into a right angle shape to fit into a corner. A table top 50 is supported in the modular pair at the right-hand end of the unit by means of couplers 14' (FIG. 5) which include inserts 16, sleeves 18' and screws 20'. The end module may be formed with a cross bar 52 integral with the tubular member 12, as best shown in FIG. 4. Also, for stability, the end module elongated tubular member 12 may be formed as shown by the dotted end portions 12A, as best shown in FIG. 5. Moreover, two such end modules, with or without arm support extensions 12'B, may be coupled together, as shown in FIG. 9 to form a free-standing support frame for a planter, table, bench, or chair.

A further table top 54 is supported in the embodiment of FIG. 4 at the corner of the structure on elongated members 56, 58 likewise by means of couplers 14, as also shown in FIG. 4. The elongated members are attached to the adjacent modular pairs, and they are turned down at one corner to form legs 56A, 58A.

Figure 6:
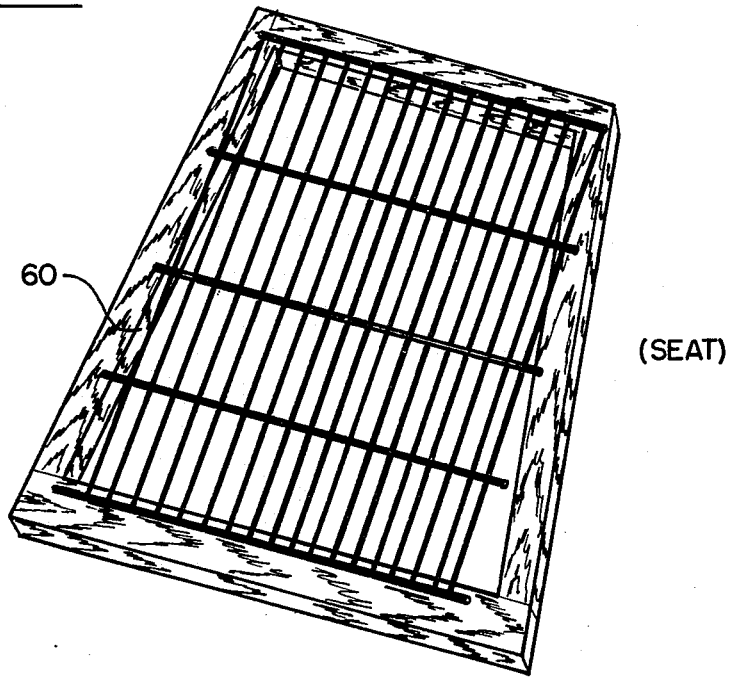
FIG. 6 is a perspective representation of a typical seat used in the assembly of FIGS. 4 and 5 which, in turn, supports a seat cushion.

Chair seats, such as the seat designated 60 in FIG. 6 are supported on the remaining modular pairs of the units of FIGS. 4 and 5. These are integral with cushions 62 which are positioned on the various seats.

Figure 7:
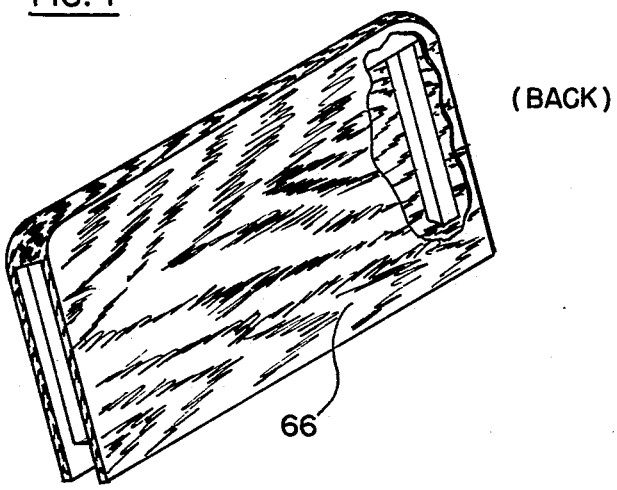
FIG. 7 is a perspective representation of a back rest for the structure of FIGS. 4 and 5, and which supports, for example, a back cushion.

A pair of L-shaped tubular members 64A, 64B are joined by a rod 71 as best shown in FIG. 4. The tubular members are mounted on each side of the modular pairs supporting the seats 60 and cushions 62, and they are secured by the underside of corresponding cross bars 26 by couplers 14. A back 66, formed of wood, or other appropriate material, such as shown in FIG. 7, is supported on each pair of L-shaped members 64A, 64B, and an integral cushion 68 is mounted over each of the backs 66.

In the embodiment of FIG. 1, the configuration of the modular pairs is such that the seats are wedge-shaped. The back supports may be mounted on the front or rear, such that each seat may have a wide back or a narrow back for concave or convex seating. Moreover, the back-supporting tubular members may be attached by means of the coupler 14 (FIG. 2) along the underside of cross bars 26, as designated by the broken lines 64'A and 64'B in FIG. 1.

Figure 8:
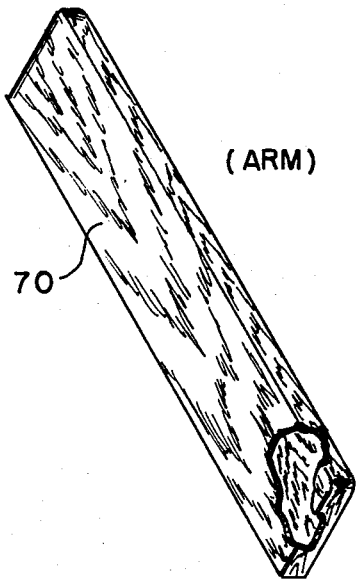
FIG. 8 is a perspective representation of an arm rest for the structure of FIGS. 4 and 5, and which, for example, supports an arm cushion.

The module at the other end of the unit of FIG. 5 includes a tubular member 12B having its upper end 12'B bent upwardly and displaced laterally from the plane of the closed end. An arm 70 (FIG. 8) composed of wood, or other appropriate material is supported on the upper end 12'B of the module 12B, and an integral cushion 72 (FIG. 4) is supported over the arm 70. The cushion 72 and arm 70 are removed in FIG. 5 to reveal the upper end 12'B of module 12B.

It will be appreciated that the modular pairs of the present invention permits a wide variety of furniture units to be formed which may incorporate, for example, any desired number of seats, with or without backs, with the unit extending linearly, or at right angles as shown in FIGS. 4 and 5, or in a curved manner as shown in FIG. 1. Also, the tables and seats may be interposed in any desired pattern, and other receptacles, such as planters, may be supported in lieu of the table tops. Appropriate straps may be provided for securing the bottom protions of the furniture units to the floor for stability purposes, if so desired.

Figure 10:
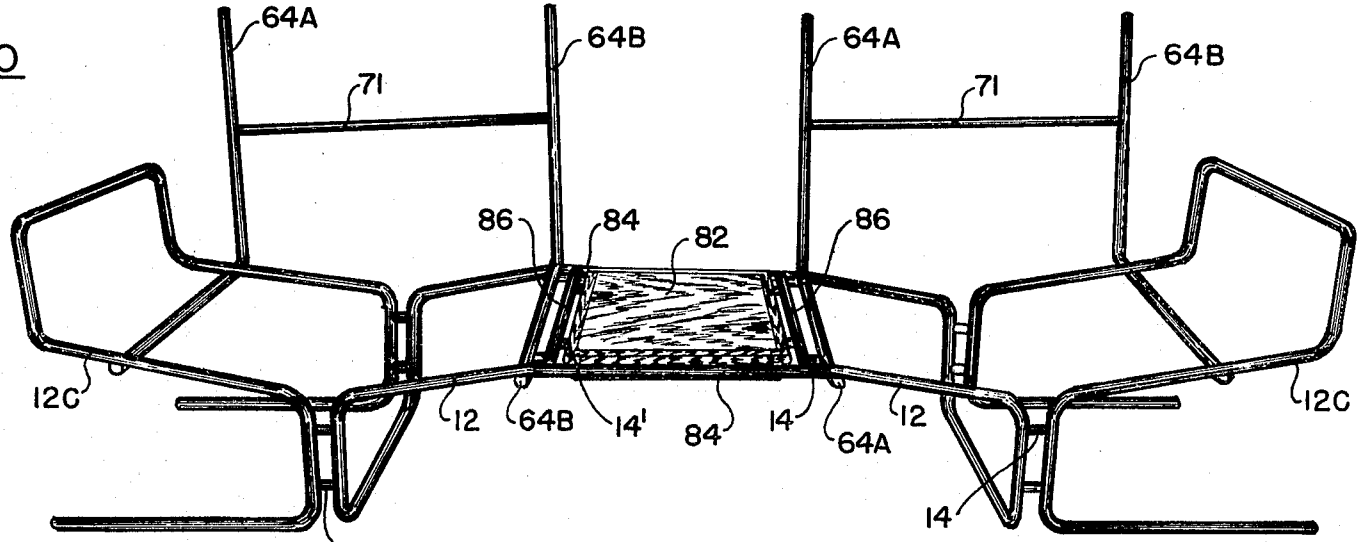
Figure 11:
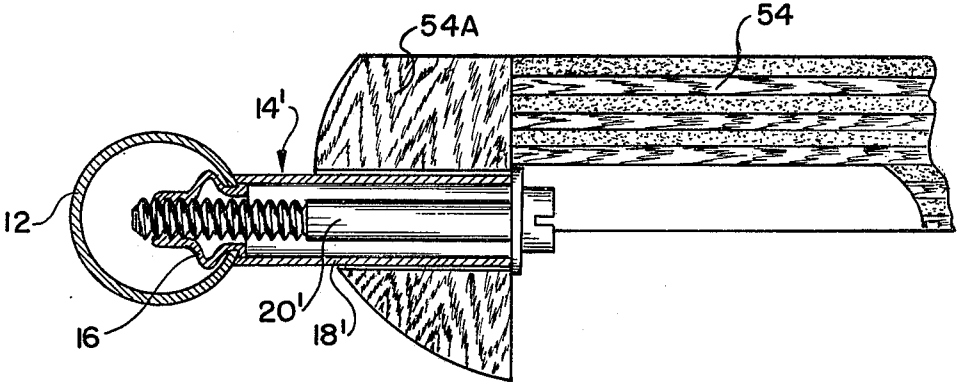
FIG. 11 shows a coupler for securing a table top to a support frame.

For example, and as shown in FIG. 10, modules 12C can be mated with modules 12 to form two modular pairs, which are interconnected by elongated members 84. A table 82 may be supported, without legs, by the elongated tubular members 84 and by elongated cross tubular members 86. Cushions may be supported on the tubular pairs and backs and arms (FIGS. 7 and 8) may be supported, as in the previous embodiments. Integral seat, arm and back cushions may also be provided.

Therefore, it will be appreciated that although particular embodiments of the invention have been shown and described, modifications may be made. It is intended in the claims to cover the embodiments which come within the spirit and scope of the invention.

I claim:

1. A modular multiple unit furniture assembly formed of a plurality of intercoupled modular pairs, each of said modular pairs comprising two modules individually formed of an elongated U-shaped tubular member bent about an intermediate axis to form a vertical section adjacent to the closed end of the U-shaped member and further to form a horizontal bent-over section adjacent to the open end of the U-shaped member, and a cross-bar extending across the open end of the U-shaped member and secured thereto, the vertical sections of the two modules forming each modular pair being positioned adjacent to one another to constitute legs for the assembly, and the bent-over horizontal section of each module being positioned adjacent to the horizontal bent-over section of one of the modules of an adjacent modular pair to constitute a seat support for the assembly; first fastening means intercoupling the vertical sections of the two modules forming the modular pair; and second fastening means intercoupling the horizontal sections of the two modules of the adjacent modular pairs.

2. The assembly defined in claim 1, in which said first and second fastening means comprise a plurality of individual couplers intercoupling the tubular members and crossbars forming the modules.

3. The assembly defined in claim 2, in which said individual couplers includes a pair of axially aligned threaded inserts respectively mounted in the elongated tubular members, a tubular bushing interposed between the threaded inserts in a coaxial relationship therewith, and a threaded stud member coaxial with the bushing and threaded into the inserts and having a threaded relationship therewith so that turning of the stud member in one direction tightens the inserts against the ends of the bushing, and turning of the stud member in the opposite direction loosens the inserts from the ends of the bushing.

4. The assembly defined in claim 1, in which said second fastening means includes plug-like inserts positioned in the ends of the elongated tubular members forming the modules.

5. The assembly defined in claim 1, in which said second fastening means includes a plurality of individual couplers intercoupling the cross-bars of adjacent ones of the modular pairs.

6. The assembly defined in claim 1, and which includes a chair seat mounted on the horizontal sections of the modules forming said modular pair.

7. The assembly defined in claim 1, and which includes a table top mounted on the horizontal sections of the modules forming one of said modular pairs.

8. The assembly defined in claim 1, and which includes a pair of L-shaped elongated members mounted in spaced and parallel relationship on at least one of said modular pairs, and a seat back mounted on the L-shaped elongated members.

9. The assembly defined in claim 1, and which includes a support frame for a corner table, seat, bench, or the like, intercoupling two such modular pairs disposed essentially at right-angles to one another, said support frame comprising elongated members attached to said tubular members of said modular pairs and circumscribing an area of substantially rectangular shape, and said elongated members of said support frame having end portions at one corner of the rectangular shape bent downwardly to constitute legs for the support frame.

10. The assembly defined in claim 1, and which includes a support frame for an intermediate table, bench, or the like, intercoupling two such modular pairs disposed essentially in spaced alignment with one another, said support frame comprising elongated members attached to said tubular members of said modular pairs and circumscribing an area of substantially rectangular shape.

* * * * *